US009109320B2

(12) United States Patent
Hanau et al.

(10) Patent No.: US 9,109,320 B2
(45) Date of Patent: Aug. 18, 2015

(54) METHOD FOR STERILIZING LAUNDRY, AND WASHING-DRYING UNIT

(75) Inventors: Andreas Hanau, Berlin (DE); Thomas Koch, Berlin (DE); Harald Moschütz, Groβbeeren (DE)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/116,500

(22) PCT Filed: May 4, 2012

(86) PCT No.: PCT/EP2012/058226

§ 371 (c)(1),
(2), (4) Date: Nov. 8, 2013

(87) PCT Pub. No.: WO2012/152683

PCT Pub. Date: Nov. 15, 2012

(65) Prior Publication Data

US 2014/0082852 A1 Mar. 27, 2014

(30) Foreign Application Priority Data

May 9, 2011 (DE) ..... 10 2011 075 501

(51) Int. Cl.
*F26B 3/00* (2006.01)
*F26B 19/00* (2006.01)
(Continued)

(52) U.S. Cl.
CPC ..... *D06F 33/02* (2013.01); *D06F 25/00* (2013.01); *D06F 35/00* (2013.01); *D06F 58/203* (2013.01)

(58) Field of Classification Search
CPC ..... A61L 2/00; D06B 1/00; B06B 3/00; B06B 19/00
USPC ..... 422/1, 28, 307; 34/329, 428, 443, 524, 34/550, 554; 134/6, 56 R, 105
See application file for complete search history.

(56) References Cited

U.S. PATENT DOCUMENTS

| | | | |
|---|---|---|---|
| 4,625,432 | A | 12/1986 | Baltes |
| 2003/0089239 | A1 | 5/2003 | Moschutz |
| 2007/0169282 | A1 | 7/2007 | Kim |

FOREIGN PATENT DOCUMENTS

| | | |
|---|---|---|
| DE | 33 43 236 | 6/1985 |
| DE | 19510001 A1 | 9/1996 |

(Continued)

OTHER PUBLICATIONS

International Search Report for PCT/EP2012/058226, mailed Sep. 6, 2012.

(Continued)

*Primary Examiner* — Monzer R Chorbaji
(74) *Attorney, Agent, or Firm* — Nixon & Vanderhye P.C.

(57) ABSTRACT

The method according to the invention for sterilizing temperature-sensitive laundry items comprises the following steps: in the dry state, the laundry items are exposed to a process air flow having a defined temperature Tp and over a specified time period, then the laundry items heated in such a way are cooled to a target temperature $Tp_{target}$ significantly lower than the temperature Tp, and then the cooled laundry items are washed in a washing process. The washing-drying unit according to the invention has a control device (CTRL) for carrying out said method.

18 Claims, 2 Drawing Sheets

(51) Int. Cl.

| | |
|---|---|
| ***B08B 7/00*** | (2006.01) |
| ***B08B 3/00*** | (2006.01) |
| ***D06F 33/02*** | (2006.01) |
| ***D06F 25/00*** | (2006.01) |
| ***D06F 35/00*** | (2006.01) |
| ***D06F 58/20*** | (2006.01) |

(56) References Cited

FOREIGN PATENT DOCUMENTS

| | | | | |
|---|---|---|---|---|
| DE | 10 2005 052960 | | 5/2007 | |
| DE | 102008062242 | A1 | 6/2010 | |
| EP | 0 148 385 | A2 | 7/1985 | |
| EP | 0 262 451 | | 4/1988 | |
| EP | 1 980 660 | | 10/2008 | |
| EP | 1 980 660 | A1 * | 10/2008 | ..... D06F 33/02 |
| JP | 4-158896 | | 6/1992 | |
| RU | 2 265 682 | C2 | 12/2005 | |
| WO | WO 96/29458 | | 9/1996 | |
| WO | WO 2010/075840 | | 7/2010 | |

OTHER PUBLICATIONS

Foreign-language Written Opinion of the International Searching Authority for PCT/EP2012/058226, mailed Sep. 6, 2012.

Foreign-language International Preliminary Report on Patentability for PCT/EP2012/058226 with 7 Amended Sheets, (Apr. 19, 2013), 16 pages.

* cited by examiner

METHOD FOR STERILIZING LAUNDRY, AND WASHING-DRYING UNIT

This application is the U.S. national phase of International Application No. PCT/EP2012/058226, filed May 4, 2012, which designated the U.S. and claims priority to German Application No. 10 2011 075 501.2, filed May 9, 2011, the entire contents of each are hereby incorporated by reference.

The invention relates to a method for sterilizing temperature-sensitive laundry items, having the following features: the laundry items are exposed, in the dry state, to a process air flow over a specified time period at a defined temperature in the absence of water and heated, and thereafter, the laundry items heated in this way are cooled to a target temperature which is significantly reduced in comparison with the defined temperature. The invention also relates to a washing-drying unit.

A method of this type and a drying and sterilization cabinet for carrying out said method are disclosed by EP 0 262 451 A2. According to said document, laundry items are sterilized immediately after being dried.

U.S. 2007/0169282 A1 and JP 4-158896 A each relate to a method and a washing machine for carrying out said method in which laundry items that are to be washed are initially treated with steam in order to sterilize and moisten said laundry items or to loosen the fibers thereof and, only thereafter, are washed with the addition of washing water.

It is well known that delicate laundry may only be washed at low temperatures (e.g. room temperature or in the range of 30° C. to 40° C.) because at higher washing temperatures, the fabric or the coloration of the laundry would suffer harmful effects and, at least over many washing cycles, would become damaged. This can result in the discoloration of a textile or the transfer of color from one textile to another. However, it is a disadvantage of washing at a low temperature that microbes in the laundry are not killed by such washing to the same extent as on washing at higher temperatures, for example 95° C. ("boil washing"). This disadvantage has conventionally been circumvented in that the still damp laundry is subsequently exposed to hot air by means of a laundry drying apparatus following the washing process.

DE 10 2005 052 960 A1 also discloses such a possibility. However, delicate laundry also suffers harmful effects in this case because, at least in the beginning phase, the laundry is exposed to the hot air while still in the damp state and the delicateness exists primarily in the damp state. In addition, a relatively large amount of energy is needed for such heating because it is not only the textile itself, but also the water contained in the textile which is heated and possibly also has to be evaporated. The possibility indicated in the document cited, of feeding the laundry to a hot air treatment for disinfecting only after the drying process is completed cannot be realized in practice since this procedure would have to be carried out in a washing-and-drying unit with a cabinet-like construction having a common treatment chamber for washing with subsequent drying and sterilization, in which the laundry is introduced hanging. Past experience has shown, however, that a design of this type would not enjoy success in the market for washing and drying devices. This concept cannot therefore be realized in practice.

DE 33 43 236 A1 discloses a drying cabinet in which the laundry is introduced, still wet from a preceding washing process, and here said laundry is initially dried and then sterilized.

It is an object of the invention to provide a method by means of which delicate laundry can be sterilized better than with conventional washing/drying processes, with the greatest possible protection of the material. It is a further object of the invention to provide a washing-drying unit by means of which the inventive method can be carried out.

This object is achieved according to the features of the independent claims. Preferred embodiments are disclosed in the dependent claims and the following description, wherein preferred embodiments of the method correspond to preferred embodiments of the washing-drying unit and vice versa, even if not explicitly indicated herein.

The method according to the invention for sterilizing temperature-sensitive laundry items accordingly has the following features:

- the laundry items are exposed, in the dry state, to a process air flow over a specified time period (T) at a defined temperature (Tp) in the absence of water and heated,
- thereafter, the laundry items heated in this way are cooled to a target temperature ($Tp_{target}$) which is significantly reduced in comparison with the temperature (Tp), and
- are (only thereafter) subsequently washed.

The method according to the invention has the advantage that the hot air which is fed to the laundry in the first method step does far less damage to the delicate laundry than during a drying process subsequent to a washing process. Due to the absence of water, the removal of color from a textile treated according to the invention and thus both the discoloration thereof and color transfer to another textile are prevented. Shrinkage of the laundry by the action of water at a raised temperature is also prevented. Another advantage lies therein that less energy is required in order to heat the (still) dry laundry for the sterilization than for the corresponding heating of conventionally damp laundry.

A preferred embodiment of the invention provides that the target temperature ($Tp_{target}$) corresponds to a room temperature ($Tp_{room}$), that is the temperature of an environment of the device or apparatus in which the method is carried out. Said temperature is thus, in particular, the temperature normally prevailing in an inhabited closed room, of approximately 20° C.

A first particularly preferred developed embodiment of the invention provides that the target temperature ($Tp_{target}$) is equal to a maximum washing temperature arising during the washing process. It is thus ensured that during subsequent washing of the laundry items, the maximum temperature permissible therefor is not exceeded in any event. A second particularly preferred developed embodiment of the invention provides that the target temperature ($Tp_{target}$) is calculated using a previously determined load quantity of laundry items which will be sterilized and a previously specified washing temperature for the subsequent washing program, so that following the addition of water to the quantity of laundry items, a temperature becomes established in the laundry items that is lower than or equal to the washing temperature. In this way, the heat used for sterilization is advantageously made use of in the subsequent washing process. Further preferably, the laundry items are dried in the conventional manner following washing, so that a connection is thus also created to a conventional drying process.

Another preferred embodiment of the invention provides that, as the specified time period (T), a time period of between five and twenty-five minutes is selected, in particular a time period of between ten and twenty minutes, inclusive in each case.

A further preferred embodiment of the invention provides that, as the defined temperature (Tp), a temperature is specified with a value in the range of 60° C. to 120° C., in particular, in the range of 70° C. to 90° C., inclusive in each case.

Another preferred embodiment of the invention provides that a temperature of the process air flow is measured immediately before the laundry items are exposed thereto and a temperature of the process air flow is measured immediately after the laundry items have been exposed thereto and both the measured temperatures are used to regulate the temperature of the laundry items.

The washing-drying unit according to the invention thus has a control device for carrying out the inventive method or one of the preferred embodiments thereof.

The washing-drying unit according to the invention therefore has a control device for carrying out a method for sterilizing temperature-sensitive laundry items in the washing-drying unit. The control device has the following functions:

said control device exposes the dry laundry items to a process air flow over a specified time period at a defined temperature in the absence of water for the heating of said laundry items, thereafter, the control device cools the laundry items that have been heated in this way to a target temperature which is significantly reduced in comparison with the defined temperature, and thereafter starts a pre-selected washing program of the washing-drying unit.

A preferred embodiment of the invention provides that a timer unit is provided in the washing-drying unit, by means of which the specified time period (T) can be set to a specifiable value.

Another preferred embodiment of the invention provides that a temperature control unit is provided in the washing-drying unit, by means of which the target temperature ($Tp_{target}$) can be specified and, in particular as stated above, can be calculated. Even more preferably, the temperature control unit has a first temperature sensor for measuring a temperature of the process air flow immediately after the laundry items have been exposed thereto, and a second temperature sensor for measuring a temperature of the process air flow directly before the laundry items are exposed thereto, and the temperature control unit is configured such that both the measured temperatures are used for regulating the temperature of the laundry items.

A further preferred embodiment of the invention provides that the control device is configured in the washing-drying unit so as to start a previously selected washing program of the washing-drying unit following ending of the cooling down process.

A preferred exemplary embodiment of the invention will now be described in greater detail making reference to the drawings, in which.

In the method, the laundry to be washed, that is, the laundry items to be washed, are heated while still in the dry state (i.e. before the start of the actual washing process) by means of a process air flow. The heating is carried out to a defined temperature Tp which is either specified in a fixed manner by the device bringing about the heating, or is pre-selectable. It is herein advantageous if the defined temperature Tp is pre-selected to lie within the range of 60° C. to 120° C., in particular, in the range of 70° C. to 90° C., inclusive in each case. Once the defined temperature Tp has been reached, the laundry is exposed to this temperature for a pre-determined time period T, wherein the time period T specified is in the range of five to twenty-five minutes, in particular, in the range of ten to twenty minutes, inclusive in each case. The time period T is either specified in a fixed manner by the device bringing about the heating or is pre-selected. Heating in the hot air flow brings about the intended sterilization, specifically almost complete killing of the microbes, for example, bacteria, viruses and mites, etc. contained in the laundry.

Following this heating process, the laundry is cooled. Following cooling, in a development of the invention, the laundry is washed in the usual manner and then dried. The drying can take place, for example, in a dryer at a low temperature suited to the delicateness of the laundry, since the sterilization of the laundry has already been carried out. The laundry is thus substantially better protected than on drying at a correspondingly higher temperature in the manner of a conventional washing-and-drying process because only in the dry state is the laundry heated above the maximum temperature permissible for washing. A further advantage of this development lies therein that the microbes killed in the preceding treatment of the laundry with the process air flow are washed out of the laundry items by the subsequent washing process and are thus removed therefrom. In the method according to the conventional washing and drying process without the preceding sterilization, the microbes are first killed in the drying process following the washing and the remains thereof remain in the dried laundry items.

The cooling process is performed, depending on the embodiment of the method according to the invention that is selected, until the sterilized laundry reaches room temperature $Tp_{room}$ or a target temperature $Tp_{target}$ which has approximately the same value as a maximum washing temperature arising in the subsequent washing process, or wherein, following the subsequent addition of water for washing, a temperature of less than or equal to the washing temperature is reached in the laundry.

Figure 1:
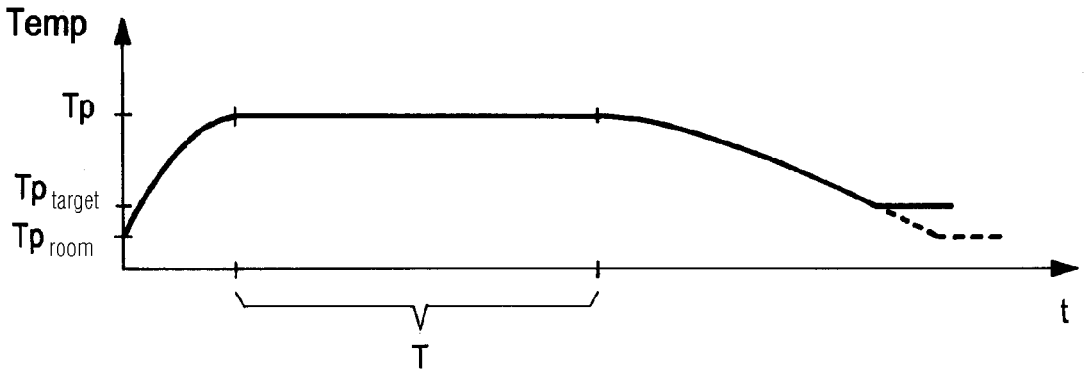
FIG. 1 is a graph of the temperature variations when the method is carried out.

FIG. 1 shows both of the possible shapes of the variation of temperature Temp over time t. In one case, the temperature Temp rises from room temperature $Tp_{room}$ to the defined temperature Tp. Once there, the temperature remains for the specified time period T then to fall to the target temperature $Tp_{target}$. In another case, the temperature curve shape is initially the same as outlined for a case above. After the end of the specified time period T, the temperature Temp falls to room temperature $Tp_{room}$, as indicated partially by the dashed line.

Figure 2:
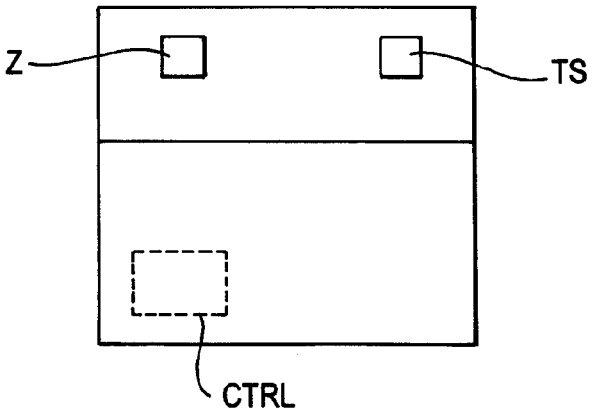
FIG. 2 is the washing-drying unit in a symbolic representation.

In order to carry out the method, it is advantageous to provide a combined washing-drying unit (in which washing and drying can be performed in the same drum, so that transferring the laundry from a washing machine into a laundry dryer is not necessary) which, according to the invention, has a control device CTRL which controls the components of a combined washing-drying unit that are typically present, for example, pump(s) for water inflow and outflow, hot air device, motor(s) for moving the washing drum and a program control unit such that, during operation, the whole method according to the invention is carried out. A combined washing-drying unit of this type is shown symbolically in FIG. 2. It is favorable if the combined washing-drying unit has a timing unit Z by means of which the defined value of the time period T can be specified. It is also advantageous if the combined washing-drying unit has a temperature control unit TS by means of which the value of the target temperature $Tp_{target}$ to which the laundry items are to be cooled at the end of the sterilization process can be specified.

The control device CTRL is advantageously configured such that following sterilization and cooling of the laundry, said control device starts a washing program which has been directly or indirectly selected in advance. Indirect selection is understood to mean that when "Sterilize" is selected, a desired washing program is also simultaneously selected.

Figure 3:
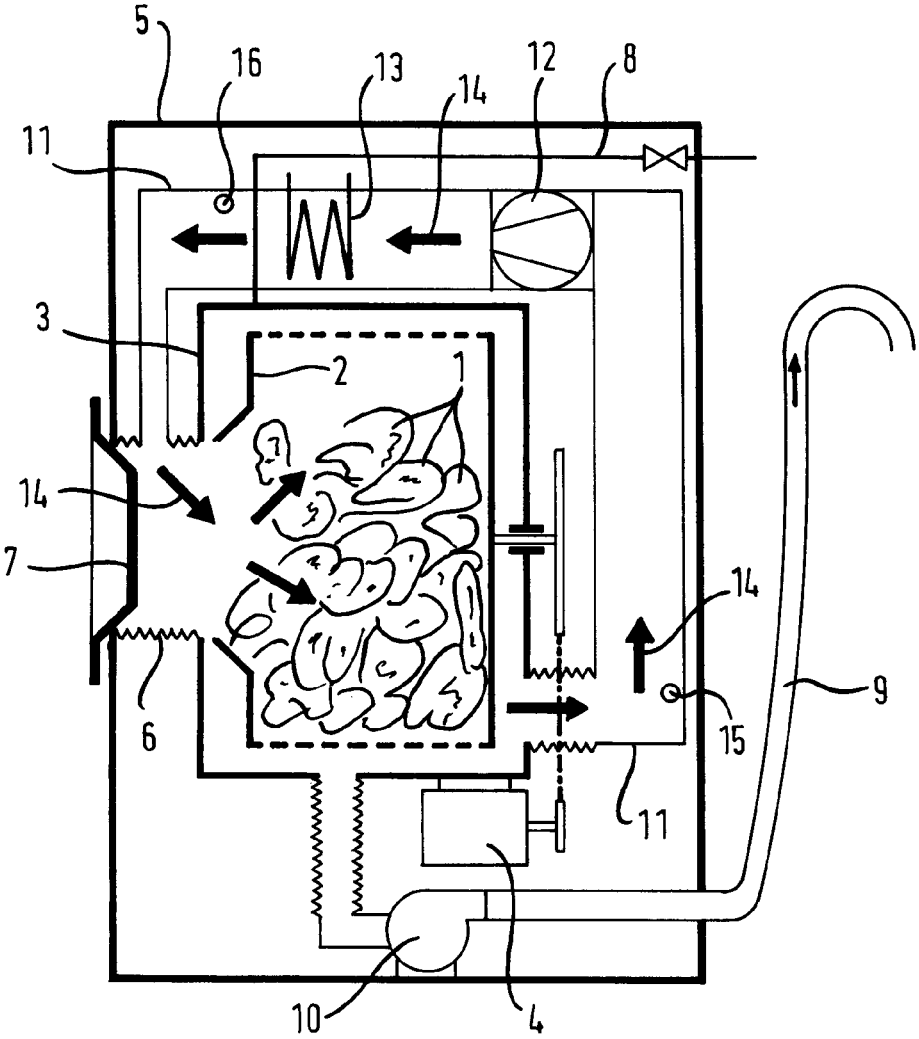
FIG. 3 is a vertical section through the washing-drying unit.

FIG. 3 shows a vertical section through a washing-drying unit. Laundry 1 can be seen within a rotatable drum 2 which is accommodated in an outer tub 3 which is mounted able to oscillate, but not rotate. A motor 4 arranged at the outer tub 3 serves to rotate the drum 2. The outer tub 3 is arranged in a housing 5 together with all the further components of the washing-drying unit. Access from outside the housing 5 to the outer tub 3 and the drum 2 is provided via a movable collar 6 which is connected in waterproof manner to the outer tub 3 and the housing 5, said access being closable by means of a door 7. An inlet 8 for fresh water and an outlet 9 for waste water, the latter also being provided with a pump 10, are also provided. The same applies for a feed-in device for laundry treatment agents and a heater arranged in the outer tub in order to heat the washing solution which, in the interests of clarity, is not shown in the present overview. A process air channel 11 having a blower 12 and a heater 13 are provided in order to drive process air, which is symbolized by arrows 14, through the drum 2 and the laundry 1 contained therein. Not shown is a condenser, by means of which moisture, which the process air heated by the heater 13 has extracted from the laundry, is condensed out of the process air, wherein the liquid condensate thereby produced flows into the outer tub 3 and is removed therefrom through the outlet 9. Two temperature sensors 15 and 16 linked to the temperature control unit TS serve to control and regulate the temperature of the flowing process air 14. A first temperature sensor 15 is placed in the process air channel 11 such that said sensor measures the temperature of the process air 14 flowing directly out of the outer tub 3, whilst the second temperature sensor 16 is placed in the process air channel 11 so as to measure the temperature of the process air 14 flowing away from the heater 13. In this way, very precise regulation of the temperature of the process air is possible in order, firstly to heat up the laundry items 1 rapidly and, secondly, to be able to keep the temperature of the laundry items 1 always at the desired level and never at an excessively high level. In order to enable rapid heating to a desired high temperature Tp, on entering the outer tub 3, the process air 14 must have a temperature slightly above the temperature Tp and in order to regulate this temperature, the second temperature sensor 16 is used. It is possible, with the first temperature sensor 15, to estimate the temperature of the laundry items 1 in the outer tub 3 relatively precisely, so that any exceeding of the temperature Tp in the laundry items 1 can be reliably prevented.

The process air channel 11 with blower 12, heater 13, first temperature sensor 15 and second temperature sensor 16 also serves to sterilize the laundry items 1, as described, in the dry state in that, in the manner already described, hot process air is fed through the dry laundry 1. This process is controlled by the aforementioned control unit CTRL which is connected to all the already mentioned components for operation and use thereof, but for the sake of clarity, is not shown in FIG. 3. Following sterilization, the laundry 1 can be washed in the conventional manner.

The combined washing-drying unit has the further advantage that, at the start of the washing process, residual heat still stored in the components thereof as a result of the preceding sterilization process, can be utilized to provide heat possibly needed for heating up the washing water for the washing process, which contributes to a (further) energy saving.

REFERENCE SIGNS t Time
T Specified time period
Temp Temperature
Tp Defined temperature
$TP_{target}$ Target temperature
$TP_{room}$ Room temperature
CTRL Control device
Z Timing unit
TS Temperature control unit
1 Laundry item
2 Drum
3 Outer tub
4 Motor
5 Housing
6 Collar
7 Door
8 Inlet
9 Outlet
10 Pump
11 Process air channel
12 Blower
13 Heater
14 Process air
15 First temperature sensor
16 Second temperature sensor

The invention claimed is:

1. A method for sterilizing temperature-sensitive laundry items (1), having the following features:

the laundry items are exposed, in the dry state, to a process air flow over a specified time period at a defined temperature in the absence of water and heated, thereafter, the laundry items heated in this way are cooled to a target temperature which is reduced in comparison with the defined temperature, and thereafter, the cooled laundry items (1) are washed in a washing process.

2. The method as claimed in claim 1, the target temperature corresponding to a room temperature.

3. The method as claimed in claim 1, the target temperature being equal to a maximum washing temperature arising during the washing process.

4. The method as claimed in claim 1, wherein the target temperature is calculated using a previously determined load quantity of laundry items which are to be sterilized and a previously specified washing temperature for the washing procedure, so that following the addition of water to the load quantity, a temperature becomes established in the laundry items that is lower than or equal to the washing temperature.

5. The method as claimed in claim 1, wherein the laundry items are dried after washing.

6. The method as claimed in claim 1, wherein, as the specified time period a time period in the range of five minutes to twenty-five minutes is selected, in particular a time period in the range of ten minutes to twenty minutes, inclusive in each case.

7. The washing-drying unit as claimed in claim 6, where the time period is 10-20 minutes.

8. The method as claimed in claim 1, wherein as the defined temperature, a temperature is specified with a value in the range of 60° C. to 120° C.

9. The washing-drying unit as claimed in claim 8, wherein the defined temperature is in the range of 70° C. to 90° C.

10. The method as claimed in claim 1, wherein a temperature of the process air flow is measured immediately before the laundry items are exposed thereto and a temperature of the process air flow is measured immediately after the laundry items have been exposed thereto and both the measured temperatures are used to regulate the temperature of the laundry items.

11. A washing-drying unit comprising a control device to carry out a method for sterilizing temperature-sensitive laundry items in the washing-drying unit, wherein the control device is configured to:

exposes the dry laundry items to a process air flow over a specified time period at a defined temperature in the absence of water for the heating of said laundry items, thereafter, cool the laundry items that have been heated in this way to a target temperature which is reduced in comparison with the defined temperature and thereafter start a pre-selected washing program of the washing-drying unit.

12. The washing-drying unit as claimed in claim 11, wherein said washing-drying unit has a timing unit by means of which the defined value of the time period can be specified.

13. The washing-drying unit as claimed in claim 11, wherein said washing-drying unit has a temperature control unit by means of which the value of the target temperature can be specified.

14. The washing-drying unit as claimed in claim 13, wherein the temperature control unit comprises a first temperature sensor for measuring a temperature of the process air flow immediately after the laundry items have been exposed thereto, and a second temperature sensor for measuring a temperature of the process air flow immediately before the laundry items are exposed thereto, and that the temperature control unit is configured such that both the measured temperatures are used to regulate the temperature of the laundry items.

15. A washing unit comprising a control device to carry out a method for cleaning temperature-sensitive laundry items in the washing unit, wherein the control device is configured to:

expose the dry laundry items to a process air flow over a specified time period at a defined temperature in the absence of water for the heating of said laundry items, thereafter, cool the laundry items that have been heated to a target temperature which is reduced in comparison with the defined temperature, and thereafter start a pre-selected washing program of the washing-drying unit.

16. The washing unit as claimed in claim 15, wherein said washing unit has a timing unit by which the defined value of the time period can be specified.

17. The washing unit as claimed in claim 15, where said washing unit has a temperature control unit by means if which the value of the target temperature can be specified.

18. The washing unit as claimed in claim 17, wherein the temperature control unit comprises a first temperature sensor for measuring a temperature of the process air flow immediately after the laundry items have been exposed thereto, and a second temperature sensor for measuring a temperature of the process air flow immediately before the laundry items are exposed thereto, and that the temperature control unit is configured such that both the measured temperatures are used to regulate the temperature of the laundry items.

* * * * *